US006015305A

United States Patent [19]

McHugh et al.

[11] Patent Number: 6,015,305

[45] Date of Patent: Jan. 18, 2000

[54] HOLDING DEVICE FOR MOUNTING CONNECTOR ON BOARD

[75] Inventors: Robert G. McHugh, Evergreen, Colo.; Yu-Ming Ho, Pen-Chiao; Ming-Chuan Wu, Taipei Hsien, both of Taiwan

[73] Assignee: Hon Hai Precision Ind. Co., Ltd., Taipei Hsien, Taiwan

[21] Appl. No.: 08/889,968

[22] Filed: Jul. 10, 1997

[51] Int. Cl.[7] ..... H01R 13/44

[52] U.S. Cl. ..... 439/135; 439/540.1

[58] Field of Search ..... 439/540.1, 532, 439/41, 940

[56] References Cited

U.S. PATENT DOCUMENTS 5,242,311 9/1993 Seong ..... 439/940

5,383,797 1/1995 Seong et al. ..... 439/135

5,688,133 11/1997 Ikesugi et al. ..... 439/135

*Primary Examiner*—Michael L. Gellner

*Assistant Examiner*—Antoine Ngandjui

[57] ABSTRACT

A holding device (10) for gripping a pair of spaced plug connectors (50) in a parallel relation, includes a plate-like body (12) defining a center portion (14) and two side portions (16) thereof wherein a pair of alignment posts (18) are disposed on the center portion (16) and a pair of retention members (22) are respectively on two side portions (16). A pair of end walls (28) are disposed on two opposite ends of the body (12) with restriction bosses (30) on the inner sides (32) for restraint of the corresponding connectors (50) in a lengthwise direction. A guidance post (34) is positioned adjacent to one boss (30) for guidably assembling the connector (50) to the holding device (10).

4 Claims, 5 Drawing Sheets

HOLDING DEVICE FOR MOUNTING CONNECTOR ON BOARD

BACKGROUND OF THE INVENTION

1. Field of the Invention

The invention relates to the device adapted to cooperate with a suction nozzle for mounting the connector to the PC board, and particularly to the device which can reliably and efficiently hold a pair of connectors for mounting to the PC board.

2. The Related Art

U.S. Pat. No. 5,249,977 discloses a cap detachably attached to a receptacle connector so that such receptacle connector can be picked and displaced, by a suction nozzle, to a specific position on the PC board for a surface mounting soldering. Recently board-to-board connectors are popularly used for interconnecting two parallel spaced PC boards. Understandably, using a pair of connectors respectively disposed on the corresponding boards for mating with each other is not mechanically reliable because these two boards may relatively swing with each other around the lengthwise direction of these two mated connectors. Therefore, to properly and evenly connect these two spaced boards, two connectors are required to be mounted to each board and designedly to be adapted to mate with the other two corresponding connectors. Under this situation, the connection area between these two boards is substantially a significant rectangular region, not a lengthwise region which tends to have the boards vibrate with each other as mentioned before.

U.S. Pat. No. 5,558,540 discloses a duplex connector assembly including a pair of connector units for cooperation with a removable holding means for mounting to a PC board. Generally speaking, it is somewhat complicated and uneasy to mold a unitary connector assembly including two juxtaposed connector units while still precisely controlling the relative positions and dimensions. Thus, some attempts have been made to use a holding device for simultaneously gripping two parallel spaced simplex connectors and mounting to one PC board. It should be noted that different from the holding device for mounting one simplex connector on a PC board as disclosed in U.S. Pat. No. 5,249,977, using one holding device for simultaneously incorporating two juxtaposed simplex connectors requires higher precision and a delicate procedure.

Therefore, an object of the invention is to provide a holding device for simultaneously gripping two spaced connectors in a parallel relation for precisely positioning on the corresponding PC board.

SUMMARY OF THE INVENTION

According to an aspect of the invention, a holding device for gripping a pair of spaced plug connectors in a parallel relation, includes a plate-like body defining a center portion and two side portions thereof wherein a pair of alignment posts are disposed on the center portion and a pair of retention members are respectively on two side portions. A pair of end walls are disposed on two opposite ends of the body with restriction bosses on the inner sides for restraint of the corresponding connectors in a lengthwise direction. A guidance post is positioned adjacent to one boss for guidably assembling the connector to the holding device.

DETAILED DESCRIPTION OF THE PREFERRED EMBODIMENTS

Figure 1:
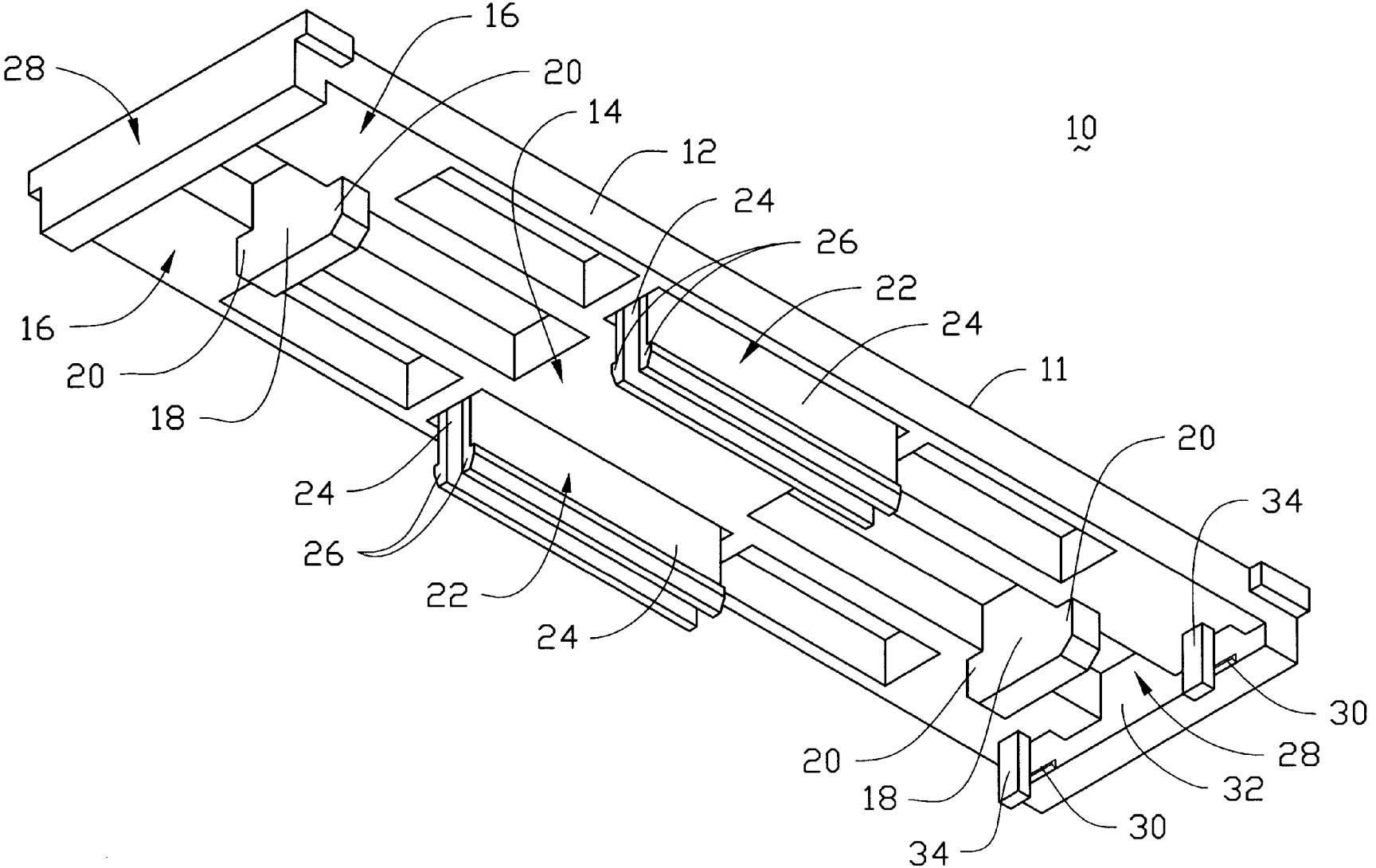
FIG. 1 is a perspective view of a presently preferred embodiment of a holding device for use with a pair of plug connectors, according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–5 wherein a holding device 10 for gripping a pair of plug connector 50 includes a plate-like main body 12 defining a center portion 14 and two side portions 16.

A pair of alignment posts 18 are disposed on the center portion 14 and each alignment post 18 includes two lateral protrusions 20 on two sides. A retention member 22 is generally positioned in the middle of each side portion 16, and includes a pair of spaced spring arms 24 downward extending in a predetermined distance wherein the tip of each spring arm 24 has an enlarged head 26.

A pair of end walls 28 extend downward at two opposite ends with two pairs of bosses 30 respectively on the inner surfaces 32 thereof in alignment with the corresponding side portions 16, correspondingly. A guidance post 34 extends downward from the body 12 adjacent to one corresponding boss 30 of each side 25 portions 16.

Figure 2:
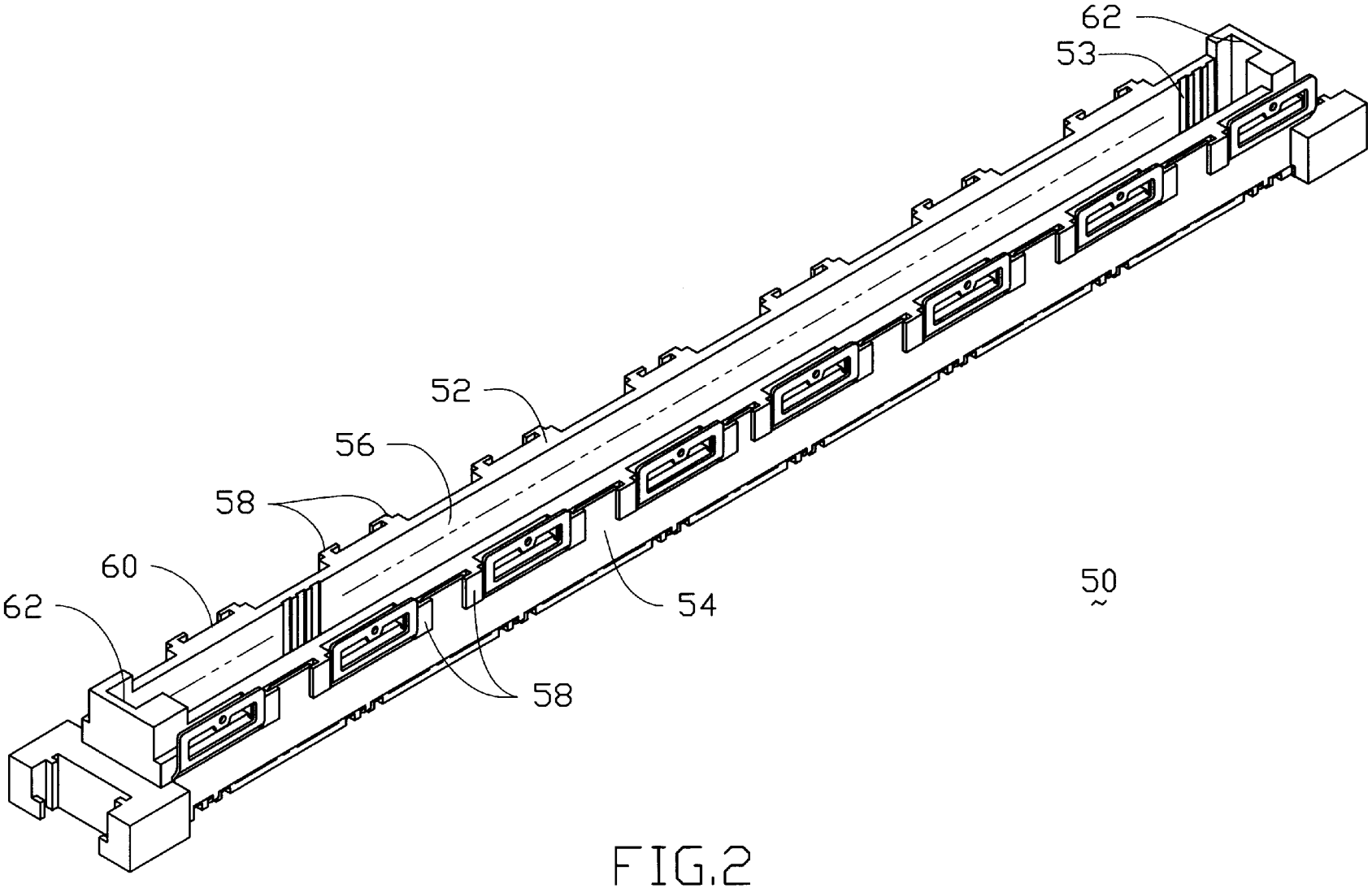
FIG. 2 is a perspective view of the plug connector for use with the subject holding device of FIG. 1 wherein the mounting ears are omitted.
Figure 3:
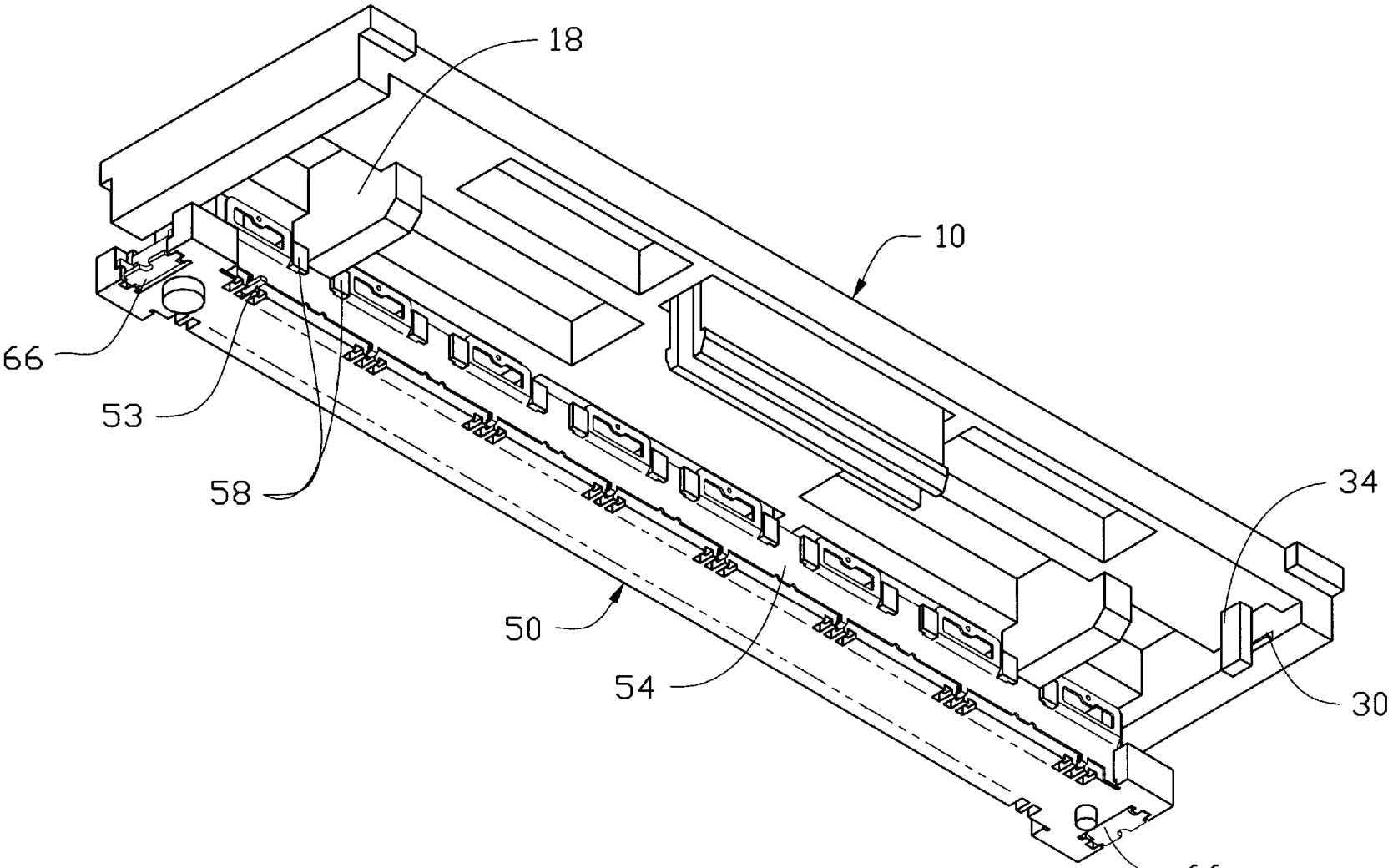
FIG. 3 is a perspective view of the assembled holding device of FIG. 1 and the corresponding plug connector of FIG. 2.

As shown in FIG. 2, the plug connector 50 which can be referred to the copending application, Ser. No. 08/795,753 filed Feb. 6, 1997, includes an insulative housing 52 with a plurality of contacts 53 (FIG. 3 only one contact shown) therein and covered by a pair of shields 54 (only one shown) on two sides, and defining a cavity 56 for receiving a complementary receptacle connector (not shown).

Pairs of raised blocks 58 are formed on the exterior surfaces 60 of the housing 52 for retaining the corresponding portions of the shield 54. A pair of recesses 62 are formed adjacent two ends of the housing 52 for cooperation with the corresponding protrusions of the complementary receptacle connector (not shown).

Therefore, when assembled, the connector 50 can be attached to the holding device 10 from the bottom wherein the guidance post 34 are respectively received within the corresponding recess 62 of the connector 50 and can properly guide assembling of the connector 50 with regard to the holding device 10. Each alignment post 18 can be snugly received within the predetermined pair of blocks 58 of the connector 50 for alignment of the connector 50 with regard to the holding device 30 in both lengthwise direction and the lateral direction. The pair of bosses 30 also provides a lengthwise alignment function for the connector 50 therebetween.

Figure 4:
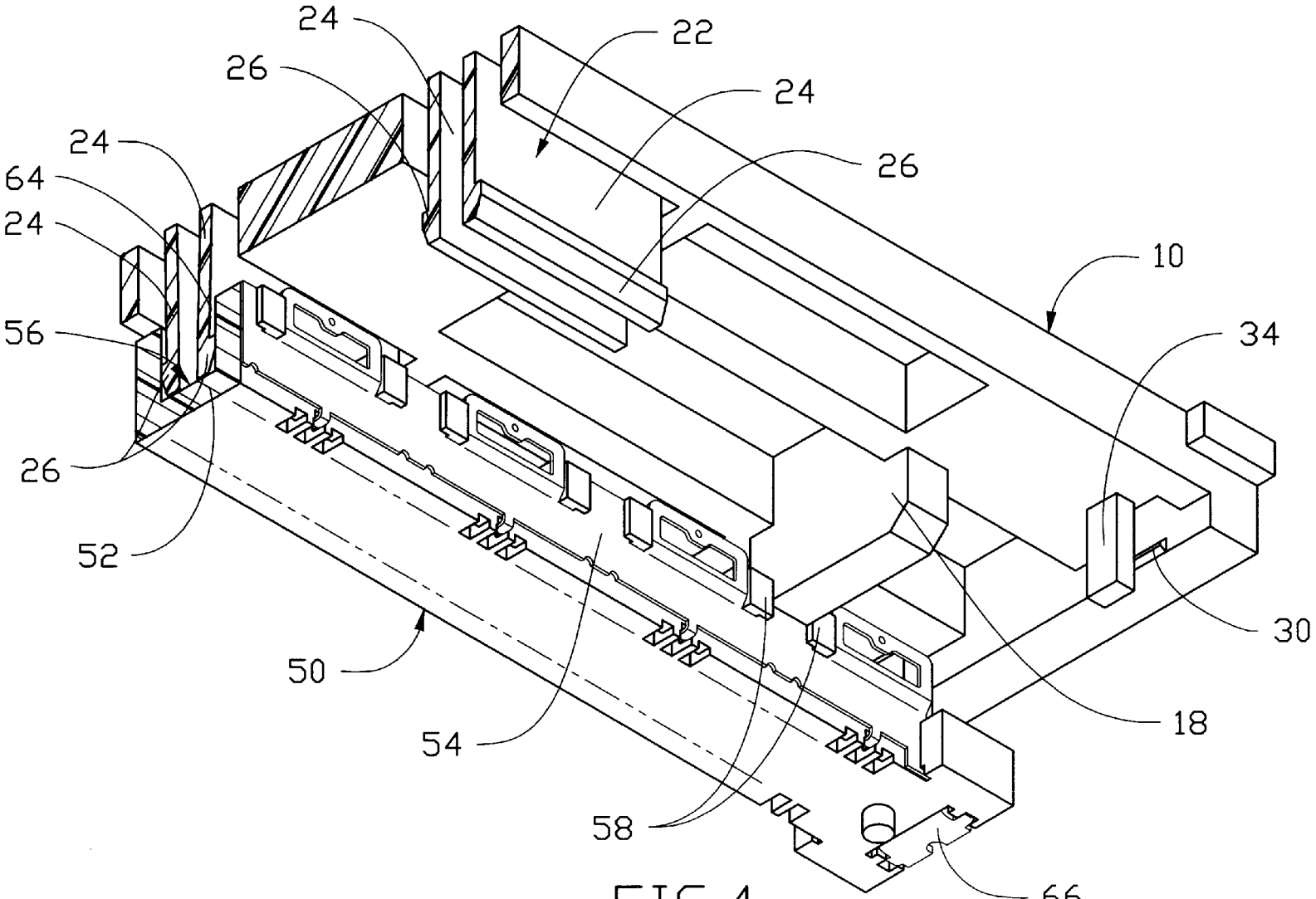
FIG. 4 is a partial cut-away perspective view of the assembled holding device with the corresponding plug connector of FIG. 3 to show how the retention member thereof retainably engages the connector and how the alignment post embedded within the two corresponding opposite blocks of the connector.
Figure 5:
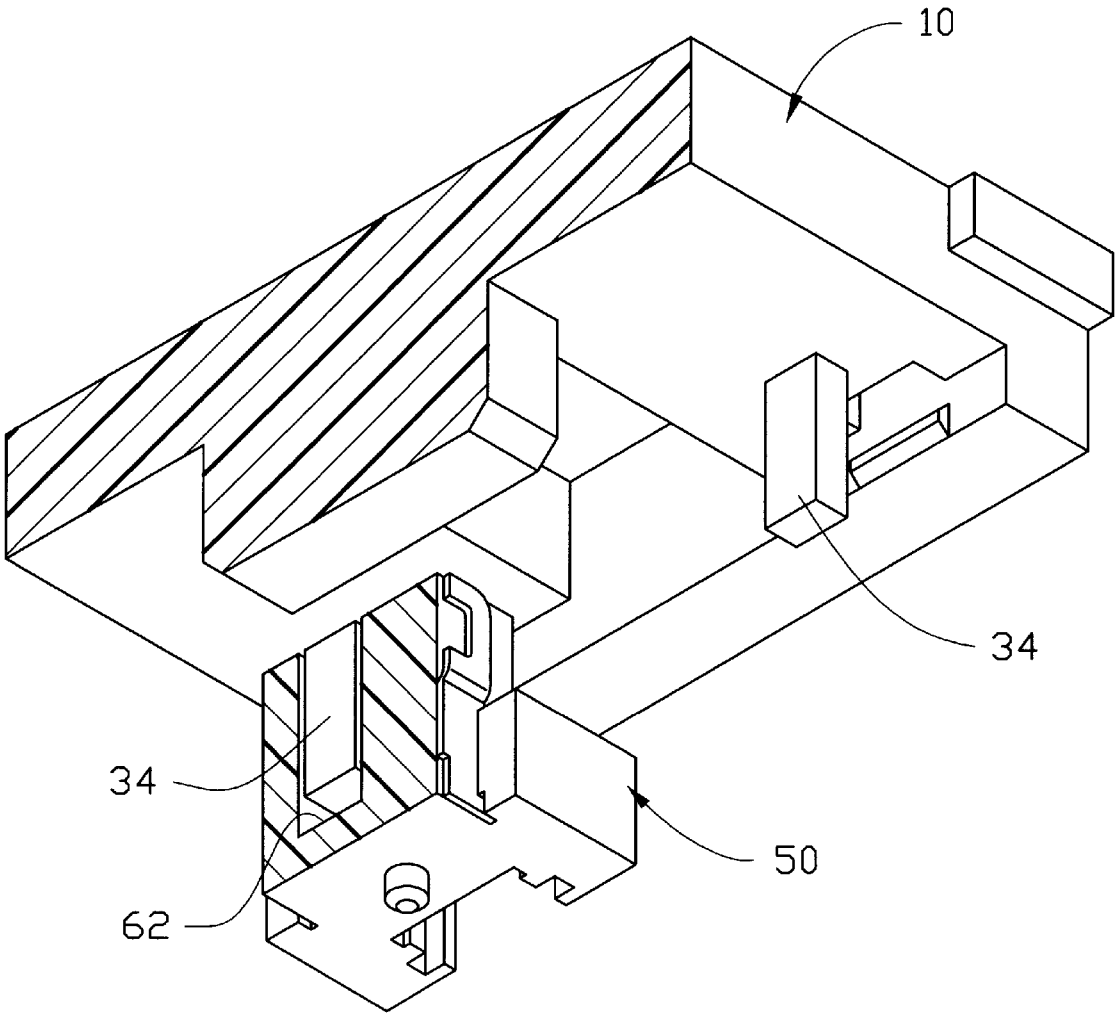
FIG. 5 is a partial cut-away perspective view of the assembled holding device with the corresponding plug connector of FIG. 3 to show how the guidance post thereof incorporates the connector.

Referring to FIG. 4, when the connector 50 is fully attached to the holding device 10, the spring arms 24 of the retention member 22 can be completely embedded within the cavity 56 of the connector 50 and provide the sufficient normal force to engage the interior surfaces 64 around the cavity 56 of the housing 52 for interferentially retaining the connector 50 in position.

It can be understood that the holding device 10 can hold two corresponding connectors 50 in a parallel spaced relationship, and then through a suction nozzle applied to the top surface 11 of the main body 12, the holding device 10 with the associated pair of juxtaposed connectors 50, can be placed to the specific region on the PC board (not shown), whereby the SMT (Surface Mount Technology) contact tails of the contact 53 can be soldered to the corresponding circuit pads on the board (not shown), and the mounting ear 66 (FIGS. 3 and 4) of the connector 50 also can be adhered to the corresponding securing pad on the board (not shown). Thus, the pair of connectors 50 are permanently secured to the board (not shown) and then the holding device 10 can be upward withdrawn from the connectors 50.

It can be appreciated that four main components of the holding device 10 provide their respective own functions. The retention member 22 provides retention of the connector 50 with regard to the holding device 10 in the vertical direction, thus assuring the connector contact tails can vertically engage the corresponding circuit pads on the board. The pair of bosses 30 provide alignment of the connector 50 with regard to the holding device 10 in the lengthwise direction, thus assuring no deviation between the contact tails of the connector and the circuit pads of the board in such lengthwise direction. The pair of alignment posts 18 not only provide lengthwise alignment for the individual connector 50 but also prevent tilt of the individual connector 50 about its lengthwise axis and therefore provide lateral alignment for controlling the two parallel connectors 50 in a designated distance spaced from each other, thus assuring no deviation between the contact tails of the connector and the circuit pads of the board in the lateral direction. The guidance posts 34 help mutually approaching between the connector 50 and the holding device 10 in a vertical direction during the assembling stage.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. In other words, the shapes or positions of the functional parts of the holding device in this embodiment may be altered for compliance with different shaped or positioned connectors.

Therefore, persons of ordinary skill in this field are to understand that all such equivalent structures are to be included within the scope of the following claims.

We claim:

1. An arrangement of holding a connector for mounting to a PC board, comprising:

a holding device with restraint means connected to both end faces, a lengthwise dimension of the holding device being somewhat larger than that of the connector so that the holding device may confine the connector therein; and at least a retention member extending downward from the holding device between said restraint means and adapted to be received within a cavity of the connector.

2. The arrangement as defined in claim 1, wherein a guidance post extends downward from the holding device adjacent to one end thereof for receivable engagement within a corresponding recess of the connector.

3. The arrangement as defined in claim 1, wherein an alignment post is provided beside the retention member for engagement within a pair of blocks on the connector.

4. The arrangement as defined in claim 3, wherein the holding device defines a center portion and two side portions whereby the alignment post is disposed on the center portion and the retention member is disposed on one of the side portions.

* * * * *